US007137794B2

(12) United States Patent
Pfetzer et al.

(10) Patent No.: US 7,137,794 B2
(45) Date of Patent: Nov. 21, 2006

(54) LIQUID PUMP

(75) Inventors: Johannes Pfetzer, Buehl (DE); Bernhard Krause, Gelsenkirchen (DE)

(73) Assignee: Robert Bosch GmbH, Stuttgart (DE)

( * ) Notice: Subject to any disclaimer, the term of this patent is extended or adjusted under 35 U.S.C. 154(b) by 362 days.

(21) Appl. No.: 10/469,745

(22) PCT Filed: Oct. 14, 2002

(86) PCT No.: PCT/DE02/03878

§ 371 (c)(1),
(2), (4) Date: Sep. 4, 2003

(87) PCT Pub. No.: WO03/067094

PCT Pub. Date: Aug. 14, 2003

(65) Prior Publication Data

US 2004/0071573 A1 Apr. 15, 2004

(30) Foreign Application Priority Data

Feb. 5, 2002 (DE) ..... 102 04 459

(51) Int. Cl.
*F04B 17/00* (2006.01)

(52) U.S. Cl. ..... 417/423.14; 417/360

(58) Field of Classification Search ..... 417/360, 417/423.1, 423.14; 415/214.1, 204, 206; 310/71, 87

See application file for complete search history.

(56) References Cited

U.S. PATENT DOCUMENTS

| | | | | |
|---|---|---|---|---|
| 3,282,221 | A | 11/1966 | Kilbane | |
| 4,198,191 | A * | 4/1980 | Pierce | 417/369 |
| 4,383,799 | A * | 5/1983 | Okano et al. | 415/214.1 |
| 4,475,873 | A * | 10/1984 | Jensen et al. | 417/422 |
| 4,546,300 | A * | 10/1985 | Shaikh | 318/786 |
| 5,375,971 | A | 12/1994 | Yu | |

FOREIGN PATENT DOCUMENTS

| | | |
|---|---|---|
| DE | 19 59 087 A | 5/1971 |
| DE | 197 18 027 A | 11/1998 |

* cited by examiner

*Primary Examiner*—Anthony D. Stashick
*Assistant Examiner*—Samuel E. Belt
(74) *Attorney, Agent, or Firm*—Michael J. Striker

(57) ABSTRACT

A fluid pump, in particular a water pump, has a pump housing (11) that surrounds a pump wheel and a motor housing, connected to the pump housing, in which an electric motor (21) driving the pump wheel is received along with a stator (22) and rotor. For the sake of sealing off the pump from the escape of fluid and sealing off the motor housing from the penetration of fluid, with only one seal, and with assembly of the fluid pump without additional connecting elements, the pump housing (11) has a lower housing part (12) with an annular rib (14) protruding radially outward, and an upper housing part (13) slipped onto the lower housing part (12). Between the free annular face end of the upper housing part (13) and the annular rib (14), there is a sealing ring (15). The motor housing is embodied as a housing pot (26), which with a gripping edge (28) fits over the annular rib (14), sealing ring (15), and part of the upper housing part (13), and is locked to the upper housing part (13), producing an axial clamping force (FIG. 3).

14 Claims, 3 Drawing Sheets

LIQUID PUMP

BACKGROUND OF THE INVENTION

The invention is based on a fluid pump, in particular a water pump.

In such fluid pumps, there is a need to seal off the pump housing from the escape of fluid and to seal off the motor housing from the penetration of fluid, such as splashing water, from the outside. To that end, it is known, after the installation of the electric motor, to seal off the motor housing in a manner proof against splashing water with a housing cap, and to tightly cover the pump housing against the escape of fluid by means of a cap flange and a sealing inlay. The pressure force between the cap flange and the pump housing required for the tight connection is achieved by screw connections, which are offset from one another by the same circumferential angles. The motor housing is secured to the cap flange, and the power takeoff shaft of the electric motor is passed through the cap flange in a sealed fashion and in the interior of the pump housing receives the pump wheel in a manner fixed against relative rotation.

SUMMARY OF THE INVENTION

The fluid pump of the invention has the advantage that for sealing off the pump housing and the motor housing, only one seal is needed, and the contact-pressure force against the seal is generated without additional fastening means. A single sealing using takes on both functions, that is, seating off the pump housing from the escape of fluid and sealing off the motor housing from the penetration of fluid from outside. The assembly and disassembly of the pump are extremely simple and allow the costs for production and repair to be dropped markedly. Since separate fastening means are not needed, the logistics of the assembly line can be simplified and some assembly toots can be dispensed with, which further contributes to lowering the production costs of the pump.

In an advantageous embodiment of the invention, the stator of the electric motor and the lower housing part of the pump housing are fixed against one another nonrotatably, and the upper housing part and the lower housing part are positioned correctly relative to one another and held nonrotatably against one another. This connection between the stator and the inner part of the housing on the one hand and the lower and upper parts of the housing on the other, preferably performed by a tongue and groove connection, serves on the one hand to provide an assembly code and on the other forms a relative-rotation preventer upon assembly, which assures a correct association of the stator, motor housing and pump housing.

In an advantageous embodiment of the invention, the locking between the housing pot and the upper housing part of the pump housing is embodied like a bayonet mount, and on the upper housing part it has protruding retaining ribs, disposed equidistantly over the circumference of the upper housing part, and on the pot edge of the housing pot it has undercuts, which can be brought into nonpositive and positive engagement with one another by relative rotation of the housing pot and upper housing part.

In an advantageous embodiment of the invention, an axially protruding stop is disposed on the upper housing part, preferably on a retaining rib, and one of the undercuts strikes this stop at the end of the relative rotation, required for the locking, of the housing pot and the pump housing. This limitation of the relative rotary motion between the housing pot and the pump housing is important so that the motor housing will always have a defined position relative to the stator, and later installation of the triggering electronics for the motor on the motor housing can be accomplished without problems.

In an advantageous embodiment of the invention, a relative-rotation preventer, which is operative once the locking has been established, is provided between the housing pot and the upper housing part when the undercut contacts the stop of the upper housing part, and which nonrotatably connects the housing pot and the pump housing to one another. This relative-rotation preventer assures that even in rough operation, the connection between the upper housing part and the housing pot will not come loose unintentionally.

In an advantageous embodiment of the invention, the pot bottom of the housing pot is provided with an oblong slot extending in the circumferential direction, through which slot the winding terminals of the stator are passed. This oblong slot makes the relative rotation between the housing pot and the electric motor stator, which is connected to the pump housing in a manner fixed against relative rotation, possible, which relative rotation is required for locking the housing pot and the upper housing part of the pump housing. The oblong slot is covered by an electronics housing, in which the triggering electronics for the electric motor are integrated.

BRIEF DESCRIPTION OF THE DRAWINGS

The invention is described in further detail in the ensuing description in terms of an exemplary embodiment shown in the drawing. Shown are.

DETAILED DESCRIPTION OF THE PREFERRED EMBODIMENTS

Figure 1:
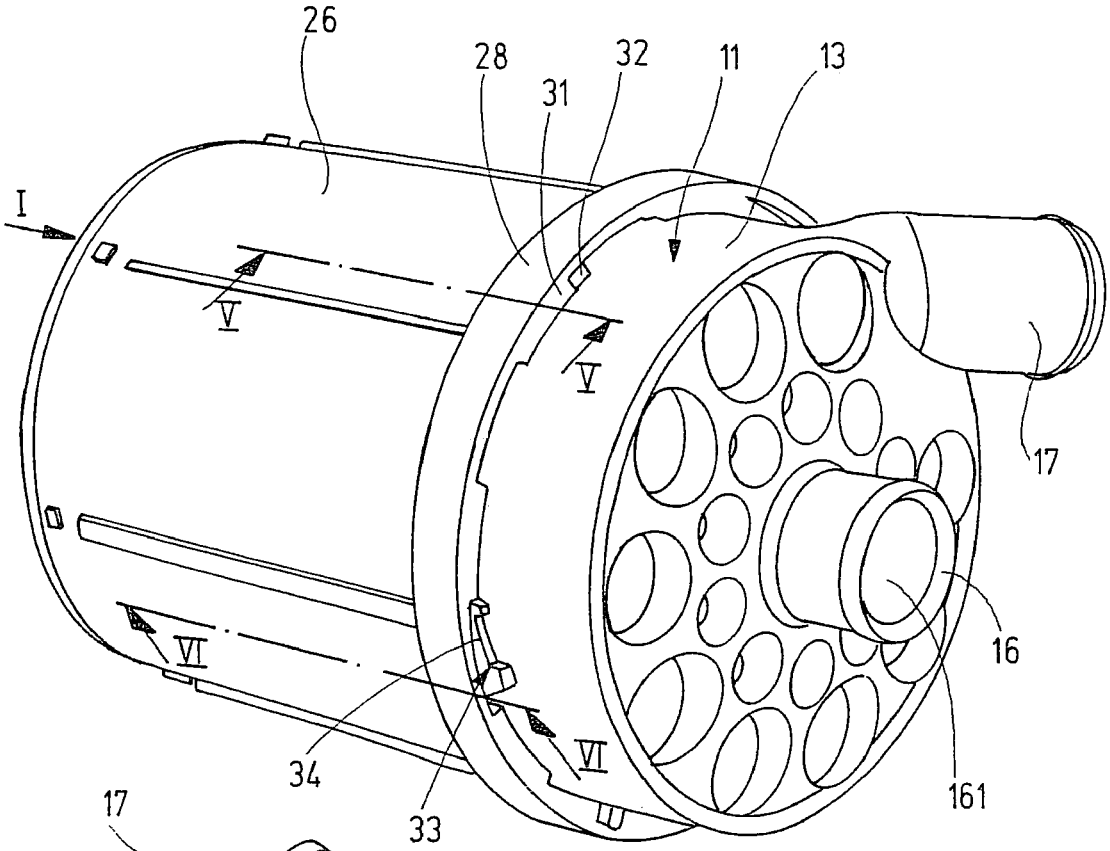
FIG. 1, a perspective view of a water pump.

The water pump, shown in perspective in FIG. 1 as an exemplary embodiment for a fluid pump in general, is preferably used in motor vehicle construction in the cooling loop of the internal combustion engine or in the heating loop of the heating system. It has a two-part pump housing 11, which is composed of a lower housing part 12 and an upper housing part 13 slipped onto the lower housing part. The lower housing part 12, on its periphery, has a radially outward-protruding annular rib 14, which serves as a support for the annular face end of the upper housing part 13 and for a sealing ring 15 slipped onto the jacket of the lower housing part 12 and located between the annular rib 14 and the face end of the upper housing part 13. An axial intake neck 16 surrounding an inlet opening 161 and an outlet neck 17 surrounding an outlet opening 171 and extending at a tangent away are formed onto the upper housing part 13. One spiral channel 181, 182 is formed in each of the two housing parts 12, 13. The two channels 181, 182, which rest congruently on one another once the upper housing part 13 has been slipped onto the lower housing part 12 form a pressure spiral 18 (FIG. 5) that discharges into the intake neck 16.

Figure 4:
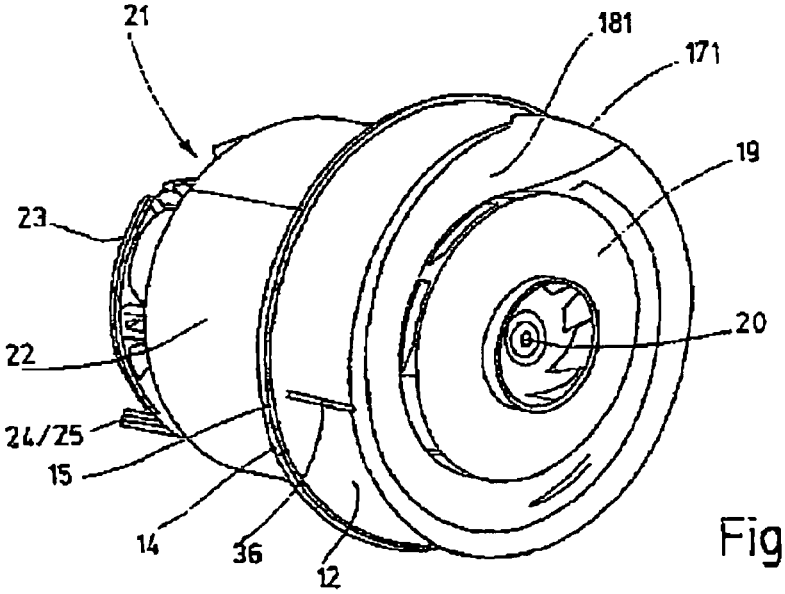
FIG. 4, a perspective view of the lower housing part of the pump housing with the pump wheel and the electric motor, driving the pump wheel, of the water pump in FIG. 1.

In FIG. 4, only the channel 181 of the pressure spiral 18 embodied in the lower housing part 12 can be seen; it is covered by the channel 182 of the pressure spiral 18 that is embodied identically in the upper housing part 13, and the outlet neck 17 on the pressure side is slipped over the edge of the orifice, which edge forms one half of the outlet opening 171, of the lower channel 181 of the pressure spiral 18. A pump wheel 19 is disposed coaxially with the axis of the pump housing 18 and is seated in a manner fixed against relative rotation on a power takeoff shaft 20 of an electric motor 21, which shaft protrudes coaxially into the pump housing 11. The rotating pump wheel 19 aspirates water axially via the intake neck 16 and pumps it into the pressure spiral 18, from which the water flows out at pumping pressure via the outlet neck 17.

Figure 2:
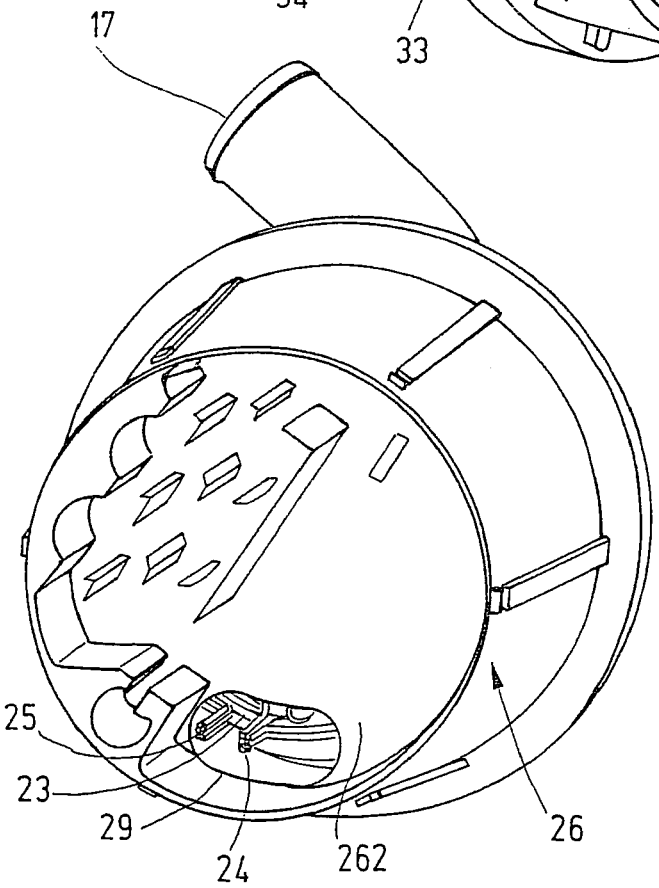
FIG. 2, a back view of the water pump, in the direction of arrow II in FIG. 1.

The electric motor 21, in a known manner, comprises a stator 22 (FIG. 4) and a rotor, not further shown here, which is surrounded annularly by the stator 22. The stator 22 has a stator winding 23, which can be supplied with current via winding terminals 24, 25 (FIG. 2). The electric motor 21 is received in a housing pot 26, which fits over the annular rib 14 on the lower housing part 12, the sealing ring 15, and part of the upper housing part 13, and which is locked to the upper housing part 13 upon the establishment of an axial clamping force between the upper housing part 12 and the housing pot 26. To that end, an annular bracing shoulder 27 (FIG. 5) for the annular rib 14 on the lower housing part 12 and a gripping edge 28 axially protruding past the bracing shoulder 27 are embodied on the pot opening 261 of the housing pot 26; when the housing pot 26 is placed on the pump housing 11, the gripping edge, with its inside face 281, slides over the annular rib 14, sealing ring 15, and a peripheral portion of the upper housing part 13, until the annular rib 14 strikes the bracing shoulder 27.

The housing pot 26, in its pot bottom 262 (FIG. 2), has an oblong slot 29 extending in the circumferential direction, through which slot the winding terminals 24, 25 of the stator winding 23 are passed. Although not otherwise shown here, an electronics housing is mounted on the pot bottom 261 and covers the oblong slot 29 and contains the triggering electronics, for instance for regulating the rotary speed, for the electric motor 21 that are to be connected to the winding terminals 24, 25.

As can be seen in FIGS. 1, 3, 5 and 6, the locking between the housing pot 26 and the upper housing part 13 is embodied like a bayonet mount, and on the upper housing part 13, it has retaining ribs 30, disposed equidistantly over the circumference, and undercuts 31 that are embodied on the gripping edge 28. The retaining ribs 30 and undercuts 31 are brought into engagement with one another by relative rotation of the housing pot 26 and the upper housing part 13 of the pump housing 11, and as the relative rotation increases, an axial displacement motion of these two components ensues, which brings about a nonpositive pressing of the sealing ring 15 placed between the annular rib 14 and the face end of the upper housing part 13.

Figure 3:
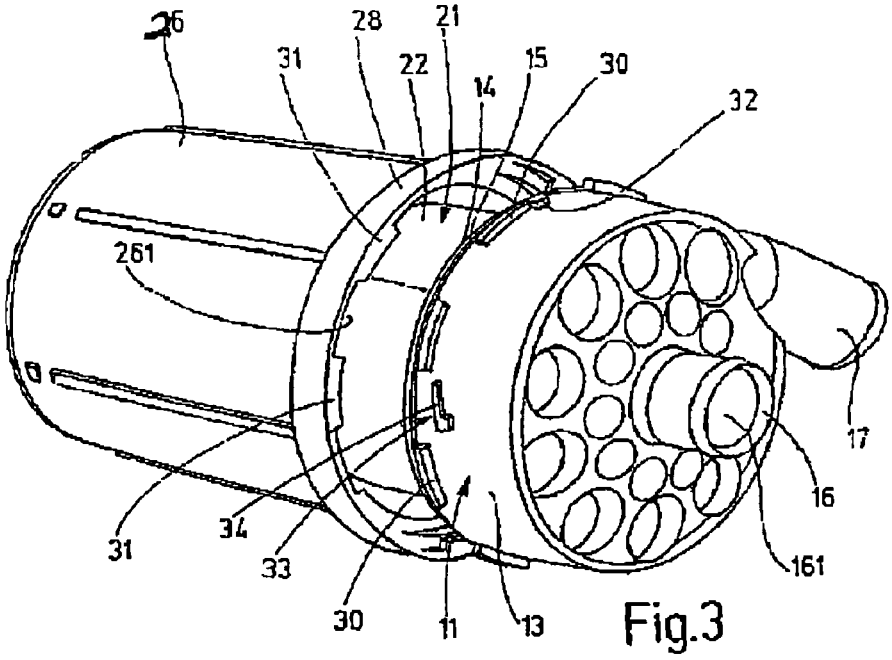
FIG. 3, the water pump of FIG. 1 with the housing pot partly removed.
Figure 6:
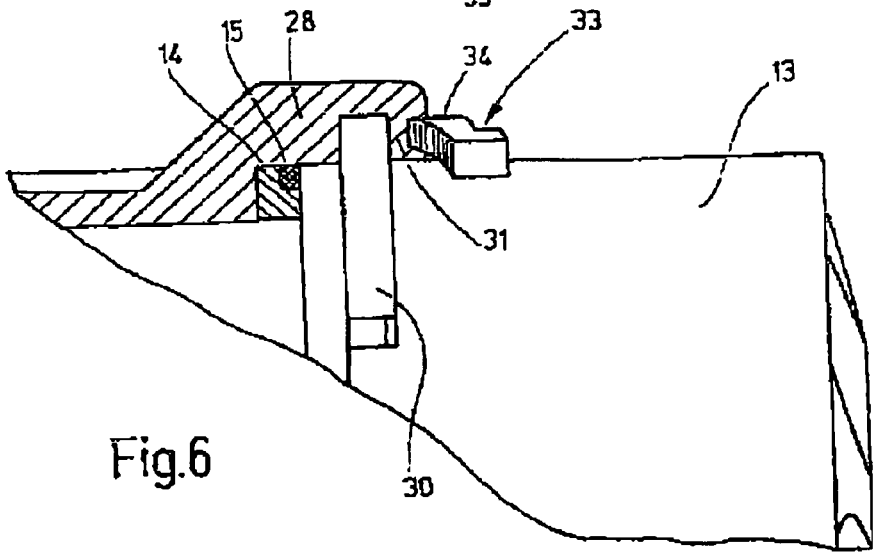
FIG. 6, a detail showing a section through the housing pot along the line VI—VI in FIG. 1, with the pump housing (not shown in section) locked to the housing pot.

The rotary motion is limited by a stop 32 (FIGS. 1 and 3), which is embodied on one of the retaining ribs 30 and protrudes axially into the path of rotation of the undercuts 31. The established locking of the housing pot 26 and the upper housing part 13 of the pump housing 11 is assured by a relative-rotation preventer 33 (FIGS. 1, 3 and 6). The relative-rotation preventer 33 has an axially elastically deformable rib 34, which protrudes outward from the upper housing part 13 and is disposed between two successive retaining ribs 30 in such a way that it is deflected elastically by one of the undercuts 31 when the housing pot 36 is being slipped onto the upper housing part 13. Once this undercut 31 has rotated to in front of the associated retaining rib 30, the rib 34 springs back again and places itself against the circumferentially pointing end edge of the undercut 31, so that reverse rotation of the housing pot 26 is prevented. A disassembly from the pump housing 11 and housing pot 26 can be accomplished, by a contrary relative rotary motion, only whenever the elastic rib 34 is lifted, with an auxiliary tool, out of the path of rotation of the undercuts 31.

Figure 5:
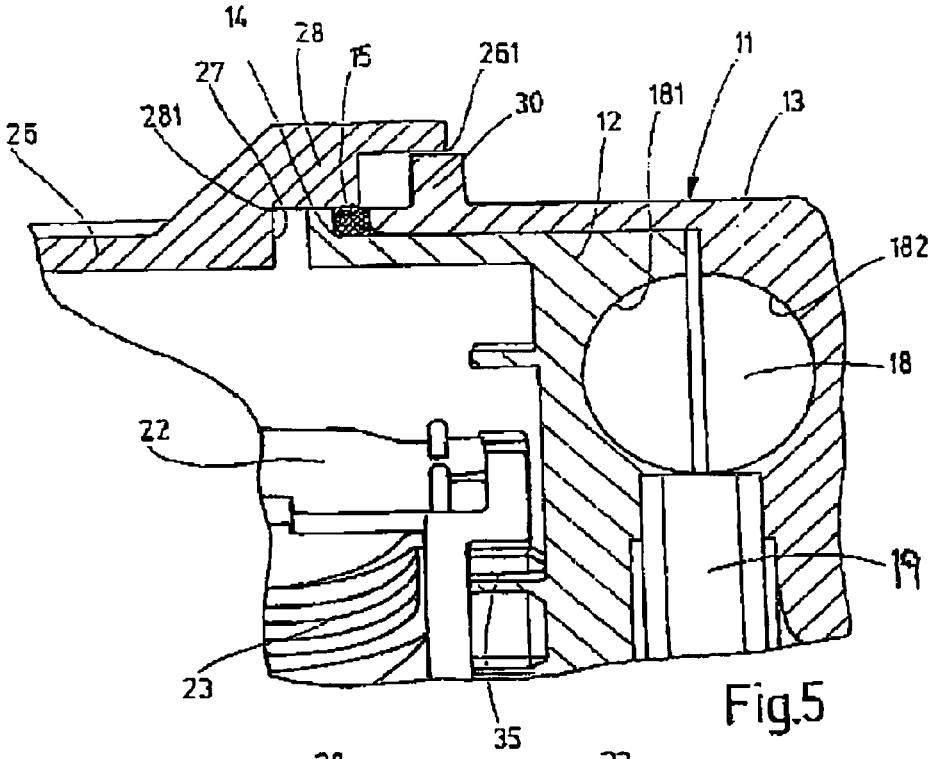
FIG. 5, a detail showing a section taken along the line V—V in FIG. 1 with the locking between the pump housing and the housing pot not yet accomplished.

The assembly of the water pump is performed as follows:

The sealing ring 15 embodied as an O-ring is mounted on the preassembled unit shown in FIG. 4, comprising the lower housing part 12, and the electric motor 21 with stator 22, rotor and power takeoff shaft 20, and this is done by slipping the sealing ring onto the jacket of the lower housing part 12 with slight expansion, until it contacts the annular rib 14 of the lower housing part 12. As the sectional view in FIG. 5 shows, the stator 22 and the lower housing part 12 are secured against relative rotation to one another by a tongue and groove connection 35. This tongue and groove connection 35 simultaneously serves as an assembly code for the correct association in terms of rotary position of the stator 22 and the lower housing part 12.

The upper housing part 13 is slipped (FIG. 3) over the preassembled unit, including the sealing ring 15. The lower housing part 12 and the upper housing part 13 are fixed nonrotatably against one another by a tongue and groove connection 36, which at the same time serves as an assembly code for the correct positioning of the upper housing part 13 and the lower housing part 12 in the process of slipping the one onto the other. Of the tongue and groove connection 36, all that can be seen in FIG. 4 is the axially extending groove in the lower housing part 12.

After the pump housing 11 has been put together, the housing pot 26 is slipped onto the stator 22 (FIG. 3), whereupon the gripping edge 28 at the pot opening 261 increasingly fits over the annular rib 14, sealing ring 15 and upper housing part 13, and the undercuts 31 slide along the gripping edge 28 between the retaining ribs 30 on the upper housing part 13. In this process, the winding terminals 24, 25 of the stator winding 23 pass through the oblong slot 29. The process of slipping the housing pot 26 on is concluded once the housing pot 27 and the lower housing part 12 abut one another at the bracing shoulder 27. Now, by a rotary motion of the housing pot 26, the undercuts 31 are rotated to in front of the retaining ribs 30, the rotary motion being limited by the stop 32. After the rotary motion of the housing pot 26, the sealing ring 15 is axially compressed and reliably seals off not only the pump housing 11 from the escape of water but also the housing pot 26 from the penetration of water. If one undercut 31 strikes the stop 32 in the rotary motion of the housing pot 26, then the rotary motion of the housing pot 26 is blocked, and the rib 34, elastically deflected by an undercut 31, of the relative-rotation preventer 33 is released again by the undercut 31, so that the rib 34 springs back into its original position and, by engaging the undercut 31 from behind, prevents a reverse rotation of the housing pot 26 in the circumferential direction (FIGS. 1 and 6).

A bayonet mount is distinguished by the fact that the retaining ribs 30 and/or undercuts 31 have an axial depth that increases in the direction of rotation, so that upon rotation of the two parts to be joined together, an axial clamping force and thus a contact-pressure force on the sealing ring 15 can be generated. Instead of being embodied with such a bayonet mount, the locking can be accomplished with retaining ribs and undercuts of the kind that have a constant axial width or thickness. In that case, the axial association of the retaining ribs 30 on the upper housing part 13 and the undercuts 31 on the housing pot 26 must be done such that in the assembly process, before and during the rotation of the housing pot 26 and pump housing 11, a pressure force that compresses the sealing ring 15 must be brought to bear, so that the undercuts 31 on the housing pot 26 can be rotated to in front of the retaining ribs 30 on the upper housing part 13.

The invention claimed is:

1. A fluid pump, in particular a water pump, comprising:

a pump housing (11) receiving a pump wheel (19); and a motor housing connected to the pump housing (11), in which motor housing an electric motor (21) that drives the pump wheel (19) is received along with a stator (22) and rotor, wherein the pump housing (11) has a lower housing part (12), with an annular rib (14) protruding radially outward, and an upper housing part (13) thrust onto the lower housing part (12), wherein between the free, annular face end of the upper housing part (13) and the annular rib (14), a sealing ring (15) is disposed, and wherein the motor housing is embodied as a housing pot (26), which fits over the annular rib (14), the sealing ring (15), and part of the upper housing part (13) and is locked to the upper housing part (13), exerting an axial clamping force.

2. The pump of claim 1, wherein an annular bracing shoulder (27) for the annular rib (14) on the lower housing part (12) and a gripping edge (28) protruding past the bracing shoulder (27) are embodied on the pot opening (261) of the housing pot (26), and the gripping edge slides with its inside face (281) past the annular rib (14), the sealing ring (15), and a portion of the upper housing part (13).

3. The pump of claim 1, wherein the stator (22) and the lower housing part (12) are positioned correctly relative to one another and fixed nonrotatably on one another, preferably via a positive-engagement connection (35).

4. The pump of claim 1, wherein the upper housing part (13) and the lower housing part (12) are positioned correctly relative to one another and fixed nonrotatably on one another, preferably via a positive-engagement connection (35).

5. The pump of claim 1, wherein the locking between the housing pot (26) and the upper housing part (13) has retaining ribs (30), protruding from the upper housing part (13) and disposed equidistantly over the circumference of the upper housing part (13). and undercuts (31), embodied on the gripping edge (28), which can be brought into engagement with one another in the manner of a bayonet mount by means of relative rotation of the housing pot (26) and the upper housing part (13).

6. The pump of claim 5, wherein an axially protruding stop (32) is disposed on the upper housing part (13), preferably on the end of a retaining rib (30), and one of the undercuts (31) strikes this stop at the gripping edge (28) at the end of the relative rotation, required for the locking, of the housing pot (26) and the pump housing (11).

7. The pump of claim 5, wherein a relative-rotation preventer (33), which is operative after the establishment of the locking, is provided between the housing pot (26) and the upper housing part (13).

8. The pump of claim 7, wherein the relative-rotation preventer (33) has at least one axially elastically deformable rib (34), which protrudes from the upper housing part (13) and is disposed such that when the housing pot (26) is slipped onto the upper housing part (13), this rib can be deflected by an undercut (31) sliding through between the retaining ribs (30), and after rotation of the undercut (31), the rib springs back in front of the associated retaining rib (30) and rests on the end face pointing in the circumferential direction of the undercut (30).

9. The pump of claim 1, wherein the stator (22) has winding terminals (24, 25) for electrical contacting of a stator winding (23), and the housing pot (26) has an oblong slot (29), extending in the circumferential direction in the pot bottom (262), through which slot the winding terminals (24, 25) extend from the housing pot (26).

10. The pump of claim 9, wherein the oblong slot (29) has a length, measured in the circumferential direction, that is greater than the rotation travel of the housing pot (26) relative to the pump housing (11) connected to the stator (22) in a manner fixed against relative rotation.

11. The pump of claim 1, wherein the pump housing (11) has an inlet opening (161) coaxial with the pump wheel (19) on the intake side and an outlet opening (171) tangential to the pump wheel (19) on the pressure side, in which outlet opening a pressure spiral (18) surrounding the pump wheel (19) discharges; and that the pressure spiral (18) is formed by two channels (181, 182), resting on one another, of which one is formed in the lower housing part (12) and one is formed in the upper housing part (13) of the pump housing (11).

12. The pump of claim 11, wherein the inlet opening and outlet opening (161, 171) are each surrounded by one of two connection necks (16, 17) formed integrally onto the upper housing part (13).

13. A fluid pump, in particular a water pump, comprising:

a pump housing (11) receiving a pump wheel (19); and a motor housing connected to the pump housing (11), in which motor housing an electric motor (21) that drives the pump wheel (19) is received along with a stator (22) and rotor, wherein the pump housing (11) has a lower housing part (12), with an annular rib (14) protruding radially outward, and an upper housing part (13) thrust onto the lower housing part (12), wherein between the free, annular face end of the upper housing part (13) and the annular rib (14), a sealing ring (15) is disposed, wherein the motor housing is embodied as a housing pot (26), which fits over the annular rib (14), the sealing ring (15), and part of the upper housing part (13) and is locked to the upper housing part (13), exerting an axial clamping force, wherein the locking between the housing pot (26) and the upper housing part (13) has retaining ribs (30), protruding from the upper housing part (13) and disposed equidistantly over the circumference of the upper housing part (13), and undercuts (31), embodied on the gripping edge (25), which can be brought into engagement with one another in the manner of a bayonet mount by means of relative rotation of the housing pot (26) and the upper housing part (13), wherein a relative-rotation preventer (33), which is operative after the establishment of the locking, is provided between the housing pot (26) and the upper housing part (13), and wherein the relative-rotation preventer (33) has at least one axially elastically deformable rib (34), which protrudes from the upper housing part (13) and is disposed such that when the housing pot (26) is slipped onto the upper housing part (13), this rib can be deflected by an undercut (31) sliding through between the retaining ribs (30), and after rotation of the undercut (31), the rib springs back in front of the associated retaining rib (30) and rests on the end face pointing in the circumferential direction of the undercut (30).

14. A fluid pump, in particular a water pump, comprising:

a pump housing (11) receiving a pump wheel (19); and a motor housing connected to the pump housing (11), in which motor housing an electric motor (21) that drives the pump wheel (19) is received along with a stator (22) and rotor, wherein the pump housing (11) has a lower housing part (12), with an annular rib (14) protruding radially outward, and an upper housing part (13) thrust onto the lower housing part (12), wherein between the free, annular face end of the upper housing part (13) and the annular rib (14), a sealing ring (15) is disposed; and that the motor housing is embodied as a housing pot (26), which fits over the annular rib (14), the sealing ring (15), and part of the upper housing part (13) and is locked to the upper housing part (13), exerting an axial clamping force, and wherein the sealing ring (15) rests against the upper housing part (13) and the lower housing part (12) of the pump housing (11) and the housing pot (26) of the motor housing.

* * * * *